US006871674B2

(12) United States Patent
Thomas et al.

(10) Patent No.: US 6,871,674 B2
(45) Date of Patent: Mar. 29, 2005

(54) APPARATUS AND METHOD OF CREATING A USE SOLUTION WITH A LOW DILUTION RATE

(75) Inventors: John E. Thomas, River Falls, WI (US); Thomas J. Batcher, Mendota Heights, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/422,063

(22) Filed: Apr. 23, 2003

(65) Prior Publication Data

US 2004/0211483 A1 Oct. 28, 2004

(51) Int. Cl.[7] ..... B65B 1/04

(52) U.S. Cl. ..... 141/9; 141/100; 141/104; 141/2; 141/18

(58) Field of Search ..... 141/9, 2, 18, 100–104; 222/129.2, 641, 133, 135; 137/892

(56) References Cited

U.S. PATENT DOCUMENTS

| | | | | |
|---|---|---|---|---|
| 4,171,710 A | * | 10/1979 | Boynton et al. | 137/238 |
| 4,350,186 A | * | 9/1982 | Schalkowsky et al. | 141/83 |
| 5,218,988 A | | 6/1993 | McNamara et al. | 137/101.21 |
| 5,301,718 A | | 4/1994 | Bolhofner | |
| 5,584,327 A | * | 12/1996 | Thomas et al. | 141/104 |
| 5,597,019 A | * | 1/1997 | Thomas et al. | 141/18 |
| 5,842,600 A | | 12/1998 | Singleterry et al. | |
| 6,395,091 B1 | | 5/2002 | Jefferson et al. | |

FOREIGN PATENT DOCUMENTS

FR 2 732 263 3/1996

OTHER PUBLICATIONS

David Robert Dudek, et al., U.S. Appl. No. 09/843,381, filed Apr. 25, 2001, published Jul. 11, 2002, as Publication No. US 2002/0091596 A1.

Louis A. Bloomfield, "How Things Work"—"Aspirator" (1997–2002) Search Results.

"Fluids: Laws and Pressures" http://tooldoc.wncc.nevada.edu/fluids.htm (Sep. 7, 2000).

Tate Western Model 300 Pump Head, obtained from Web Site on (Mar. 24, 2003).

Tate Western OEM Engineering Manual (Jan. 2002).

* cited by examiner

*Primary Examiner*—Steven O. Douglas
(74) *Attorney, Agent, or Firm*—IPLM Group, P.A.

(57) ABSTRACT

An apparatus for creating a use solution of a concentrate diluted, with a dilution rate of not more than 1:130, into a diluent flowing under pressure in a line. A normally-closed, user activatable valve is operatively coupled in the line allowing the diluent to flow in the line upon user activation. A flow regulator is operatively coupled in the line downstream of the valve, configured to maintain a constant flow rate for the diluent in the line. A constant flow rate pump having an inlet and an outlet is operatively coupled to the valve. The inlet is adapted to be operatively fluidly coupled to the concentrate. The outlet is fluidly coupled to the line downstream of the flow regulator.

21 Claims, 3 Drawing Sheets

APPARATUS AND METHOD OF CREATING A USE SOLUTION WITH A LOW DILUTION RATE

TECHNICAL FIELD

This invention relates to product dilution apparatus and methods and, more particularly, to product dilution apparatus and methods having low dilution rates.

BACKGROUND

Often apparatus and methods are used to add a concentrate to a diluent in order to create an effective use solution. Diluting a concentrate with water flowing in a water line is one example. Using an active ingredient in concentrated form and relying on-site dilution of the active ingredient allows more efficient use of shipping and storage of the active ingredient. The volume and weight of the water diluent need not be shipped to the point of usage nor stored at the point of usage.

In the cleaning environment, it is common to dilute a concentrate of a sanitizer or cleaner on-site with locally supplied water. Apparatus and methods are commonly used to dilute the concentrated sanitizer or cleaner, for example, to form a commercially suitable use solution.

Aspirators are commonly used for this purpose. An aspirator is essentially a pipe (the water line) with a narrowing in it. As water flows through that narrowing, the velocity of the water increases and the water pressure drops. An opening on the side of line is connected to a hose which, in turn, is connected to the concentrate. Since the water pressure in the high speed water flow is lower than atmospheric pressure, atmospheric pressure pushes the concentrate through the connected tube into the water flowing through the line.

Such aspirators work well to add concentrate to water flowing in a line at certain amounts of dilution. At dilution rates down to approximately 1:130 (that is, a dilution rate of one part concentrate to 130 parts diluent), the amount of concentrate being added to the water diluent can be controlled by varying the size of the opening on the side of the line. Making the opening larger increases the amount of concentrate added to the line. Making the opening smaller decreases the amount of concentrate added to the line.

However, at dilution rates lower than approximately 1:130 (that is, one part concentrate to more than 130 parts diluent), it is difficult to control the amount of concentrate added to the line by simply varying the size of the opening in the side of the line. At low dilution rates, i.e., small amounts of concentrate added to the line, variations in the water pressure, flow rate, temperature of the water can all result in significant variations in the amount of concentrate added to the water (diluent) in the line. Further, it is easy to plug the opening into the line with foreign material limiting the amount of concentrate which is added to the diluent flowing in the line or completely eliminating any concentrate to the line. Thus, it is difficult to accurately use an aspirator to add concentrate to a diluent flowing in a line with the use of an aspirator.

However, many applications require just such low dilution rates. An example is the addition of a sanitizer to form a use solution for a warewashing application. If highly concentrated sanitizer is utilized, dilution rates of approximately one part in one hundred thirty to one part in one hundred fifty or less may be desired. An aspirator is often unreliable and unworkable in this situation.

Thus, there is needed an apparatus and method to accurately control the addition of a concentrate to a diluent flowing in a line at dilution rates not more than 1:130.

SUMMARY OF THE INVENTION

The present invention solves this problem, in part, by using a pump with a constant flow rate, such as a peristaltic pump, to add a specifically controlled amount of concentrate to the diluent flowing in the line. A flow control valve provides ensures that the diluent flowing in the line has a known rate of flow. By precisely controlling the constant flow rate pump, a variable amount and precisely known amount of diluent can be added to the line. Variations in water pressure and water temperature have little effect of the combination of concentrate and diluent forming the use solution in the line.

In one embodiment, the present invention provides an apparatus for creating a use solution of a first product diluted, with a dilution rate of not more than 1:130, and a second product diluted, with a dilution rate of more than 1:130, into a diluent flowing under pressure in a line. A normally-closed, user activatable valve is operatively coupled in the line allowing the second product to flow in the line upon user activation. A flow regulator is operatively coupled in the line downstream of the valve, configured to maintain a constant flow rate for the diluent in the line. An aspirator is adapted to be fluidly coupled to the second product and operatively coupled in the line downstream of the flow regulator. A constant flow rate pump having an inlet and an outlet is operatively coupled to the valve. The inlet is adapted to be operatively fluidly coupled to the first product. The outlet is fluidly coupled to the line downstream of the flow regulator.

In a preferred embodiment, the diluent is water.

In a preferred embodiment, the constant flow rate pump is a peristaltic pump.

In a preferred embodiment, a pressure-operated electrical switch is fluidly coupled in the line downstream of the valve and is electrically coupled to the pump configured to activate the pump when the diluent flows in the line.

In a preferred embodiment, a vacuum break is operatively coupled in the line between the valve and the flow regulator.

In a preferred embodiment, the valve is a latching solenoid valve which opens for a predetermined period of time upon user activation.

In a preferred embodiment, the outlet of the pump is coupled in the line downstream of the aspirator.

In a preferred embodiment, the first product is a fragrance.

In another embodiment, the present invention provides a method of creating a use solution of a first product diluted, with a dilution rate of not more than 1:130, and a second product diluted, with a dilution rate of more than 1:130, into a diluent flowing under pressure in a line. A normally-closed, user activatable valve operatively coupled in the line is opened allowing the second product to flow in the line. The flow in the line downstream of the valve is regulated to maintain a constant flow rate for the diluent in the line. The second product is aspirated into the line downstream of the flow regulation. The first product is pumped into the line downstream of the flow regulation using a constant flow rate pump.

In a preferred embodiment, the first product is pumped into the line downstream of where the second is aspirated into the line.

In an alternative embodiment, the present invention provides a method of distributing a product to each of a plurality of customers. The product is constituted from a base concentrate and a customizable concentrate selectable from a plurality of customizable concentrates. The base concentrate is distributed to each of the plurality of customers. A different selected one of the plurality of customizable concentrates is distributed to each of the plurality of customers. The base concentrate is diluted with a locally obtained diluent. The selected one of the plurality of customizable concentrates is diluted at a dilution rate of not more than 1:130 with the locally obtained diluent.

In a preferred embodiment, the diluent is water.

In a preferred embodiment, the customizable concentrate is a fragrance.

In a preferred embodiment, the base concentrate is a sanitizer.

In a preferred embodiment, the base concentrate is a cleaner.

DETAILED DESCRIPTION

Figure 1:
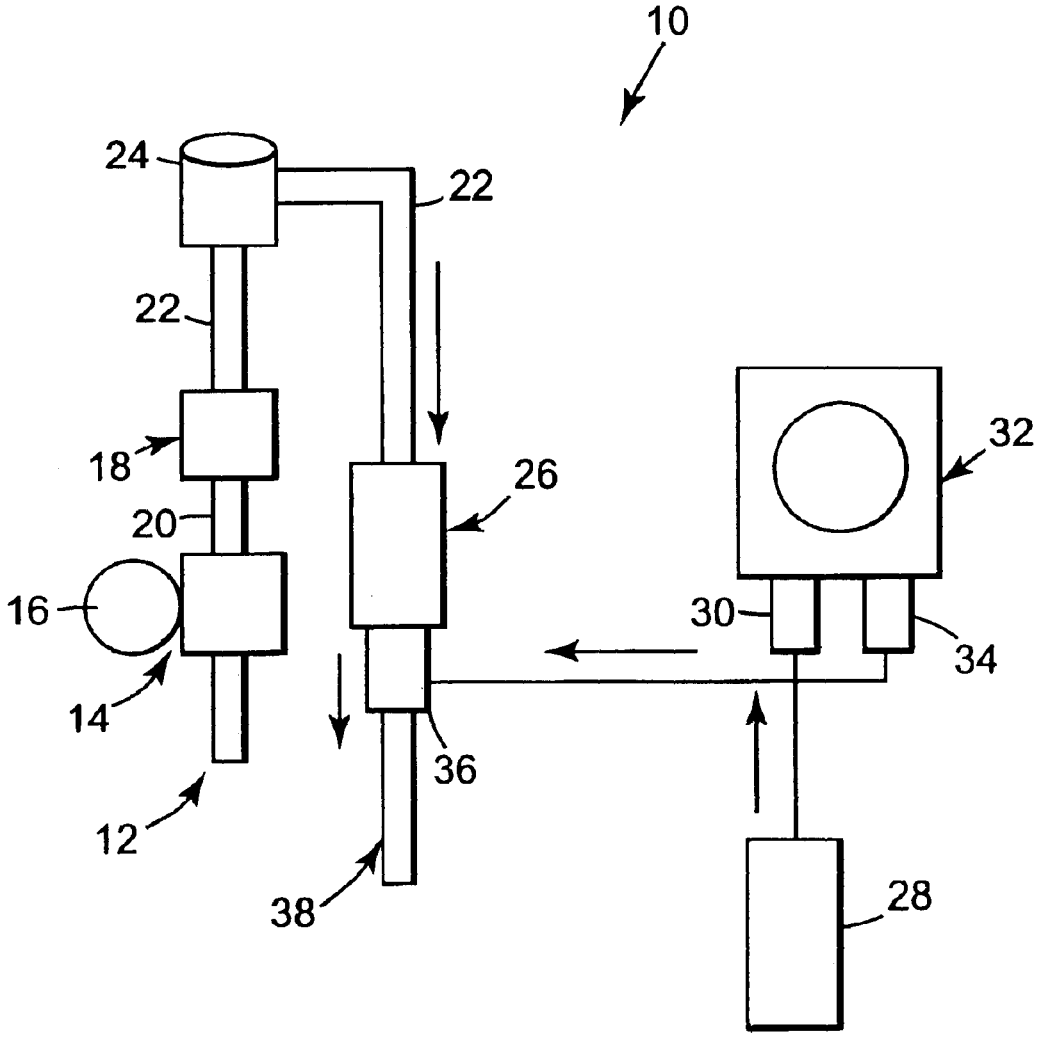
FIG. 1 is a block diagram of an embodiment of the present invention diluting one ingredient.

In FIG. 1, apparatus 10 is coupled to a source of supply of water by water supply line 12. A water pressure regulator 14 and, preferably, pressure gauge 16, control the pressure in water supply line 12 so that the water pressure is maintained relatively constant, e.g., having a deviation of plus or minus five percent (5%). Preferably, the water pressure is maintained in within that tolerance in the range of 35 to 50 pounds per square inch (241 to 345 kilopascals).

Latching solenoid valve 18 is coupled into water line 20 downstream of water pressure regulator 14. Latching solenoid valve 18 is manually operable by a user. Water flow through latching solenoid valve is normally prevented. When a user operates latching solenoid valve 18, water is allowed to flow through water line 22. Once activated by a user, latching solenoid valve 18 allows water to flow through water line for a predetermined or selectable period of time. This time period is set based on the volume of use solution desired to be produced, e.g., the volume of a container or containers into which a use solution created by apparatus 10 is to be placed. At dilution ratios in the range of 1:130 or lower, most of the volume of the use solution will consist of water flowing through latching solenoid valve 18. Once latching solenoid valve 18 times out, water flow through water line 22 is again halted. Thus, latching solenoid valve 18 operates, once activated by a user, to allow a predetermined or selectable amount of water to pass through water line 22.

Vacuum break 24 is positioned in water line 22 downstream from latching solenoid valve 18. Plumbing codes in many jurisdictions require a vacuum break, such as vacuum break 24, to ensure that water downstream of vacuum break 24 does not flow backwards in water line 22 in the event of loss of water pressure in water supply line 12, possibly contaminated the water source supplying water supply line 12. Vacuum break 24 can be any of a number of conventional vacuum breaks, such as incorporating a one inch (2.54 centimeters) air gap.

Flow control 26 maintains a constant rate of flow of water in water line 22. In a preferred embodiment, flow control 26 maintains a flow rate of one gallon (3.8 liters) per minute. Having an accurate and consistent rate of flow in water line 22 enables apparatus 10 to produce an accurate and consistent dilution rate. If the volume of water flowing in water line 22 is known, a precise amount of concentrate added to water line 22 will produce a known dilution rate.

Concentrate 28 is fluidly coupled to inlet 30 of constant flow rate pump 32. Outlet 34 is fluidly coupled, via tee 36, to water line 22. Constant flow rate pump 32 is electrically power and is electrically activated by latching solenoid valve 18. Thus, when a user manually activates latching solenoid pump 18 to allow water flow through water line 22, constant flow rate pump 32 is also activated. Thus, whenever water is flowing through water line 22, constant flow rate pump 32 is also pumping concentrate 28 into water line 22.

Constant flow rate pump 32 may be manually or automatically adjustable to vary the rate at which concentrate 28 is pumped into water line 22, or constant flow rate pump can simply pump concentrate 28 in water line 22 at a predetermined rate.

Since the rate of flow of water in water line 22 is known and the rate at which concentrate 28 is pumped into water line 22 can be controlled by constant flow rate pump 32, the dilution rate of concentrate 28 to water in water line 22 can not only be known but can also be controlled very accurately.

A peristaltic pump is an example of a pump that can be used as constant flow rate pump 32. A peristaltic pump operates with a roller or rollers compressing a tube containing the liquid being pumped, in this case, concentrate 28. The flow rate through a peristaltic pump can be precisely controlled by controlling the rate of rotation of the roller or rollers, the inside diameter of the tubing used in the peristaltic pump and the distance between rollers. The distance between rollers and the inside diameter of the tubing creates a known volume of material being pumped. The rate of rotation of the rollers determines the rate at which that known volume of material is delivered. The advantage of a peristaltic pump is the control on the amount of material being pumped and the rate at which that material is pumped.

In a preferred embodiment, constant flow rate pump 32 is commercially available model 300 peristaltic pump manufactured by Tate Western, a SHURflo company, 36 Aero Camino, Santa Barbara, Calif. Seven different tube sizes resulting in pump volumes from ⅛ cubic centimeters per revolution to 3 cubic centimeters per revolution are available. Pressures from 25 to 60 pounds per square inch (172 to 414 kilopascals) are possible depending on tube size. A preferred tubing size is ¼ cubic centimeters per revolution.

Fluid then flowing in outlet pipe 38 is a precisely diluted mixture of water (diluent) and concentrate 28. Outlet pipe 38 may be operatively coupled to a use solution container (not shown) or may otherwise be coupled, e.g., directly, to a location where the desired use solution is to be used.

Figure 2:
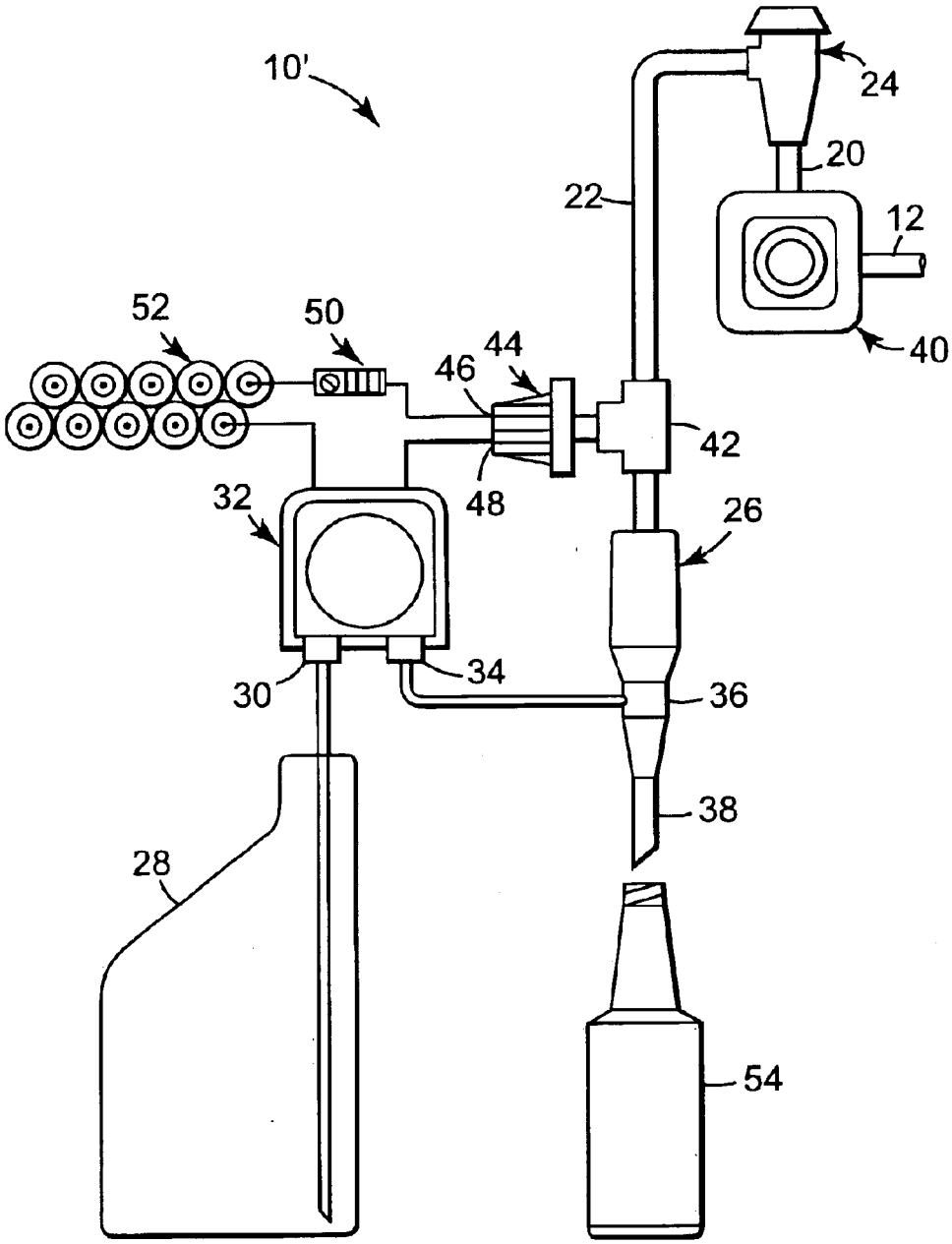
FIG. 2 is a block diagram of an alternative embodiment of the present invention also diluting one ingredient.

FIG. 2 illustrates an alternative embodiment of apparatus 10 of the present invention. Incoming water supply line 12 is directly coupled to push button water valve 40. In contrast to latching solenoid valve 18 used in the embodiment illustrated in FIG. 1, push button water valve 40 operates to deliver water from water supply line 12 to water line 20 whenever a user pushes a button on push button water valve 40. Water flows in water line 20 whenever a user pushes and holds a button on push button water valve 40. Water stops flowing in water line 20 when a user ceases to push a button on push button water valve 40. Thus, push button water valve operates to make as much use solution as desired by the user by simply pushing and holding push button water valve 40 until the desired volume of use solution is obtained.

Vacuum break 24 connected in water line 20 downstream of push button water valve 40 performs the same function as in the embodiment illustrated in FIG. 1. Tee 42 in water line 22 downstream of vacuum break 24 allows pressure switch 44 to be fluidly coupled to water line 22. Flow control 26 and tee 36 also perform the same function as in the embodiment illustrated in FIG. 1.

Electrical outputs 46 and 48 of pressure switch 44 are electrically connected through voltage regulator 50 and battery pack 52 to constant flow rate pump 32. Inlet 30 of constant flow rate pump 32 is fluidly coupled to concentrate 28. Outlet 34 of constant flow rate pump 32 is fluidly coupled into outlet pipe 38 via tee 36. Container 54 is positioned to receive use solution from outlet pipe 38.

In operation, when water pressure exists in water line 22, pressure switch 44 makes continuity between outputs 46 and 48 allowing battery pack 52 to energize constant flow rate pump 32. Thus, no direct electrical connection is required between push button water valve 10 and constant flow rate pump 32. Whenever a user pushes a button of push button water valve 40 to activate the flow of water in water line 22, water pressure against pressure switch 44 will electrically activate constant flow rate pump 32. Thus, whenever diluent (water) is flowing through water line 22, constant flow rate pump 32 is adding concentrate 28 to outlet pipe 38 ensuring that the resulting use solution has the proper ratio of concentrate 28 and diluent (water). When a user obtains a sufficient amount of use solution in container 54, the user releases the button on push button water valve 40 stopping the flow of water (diluent) and stopping the pumped addition of concentrate 28 into outlet pipe 38.

Figure 3:
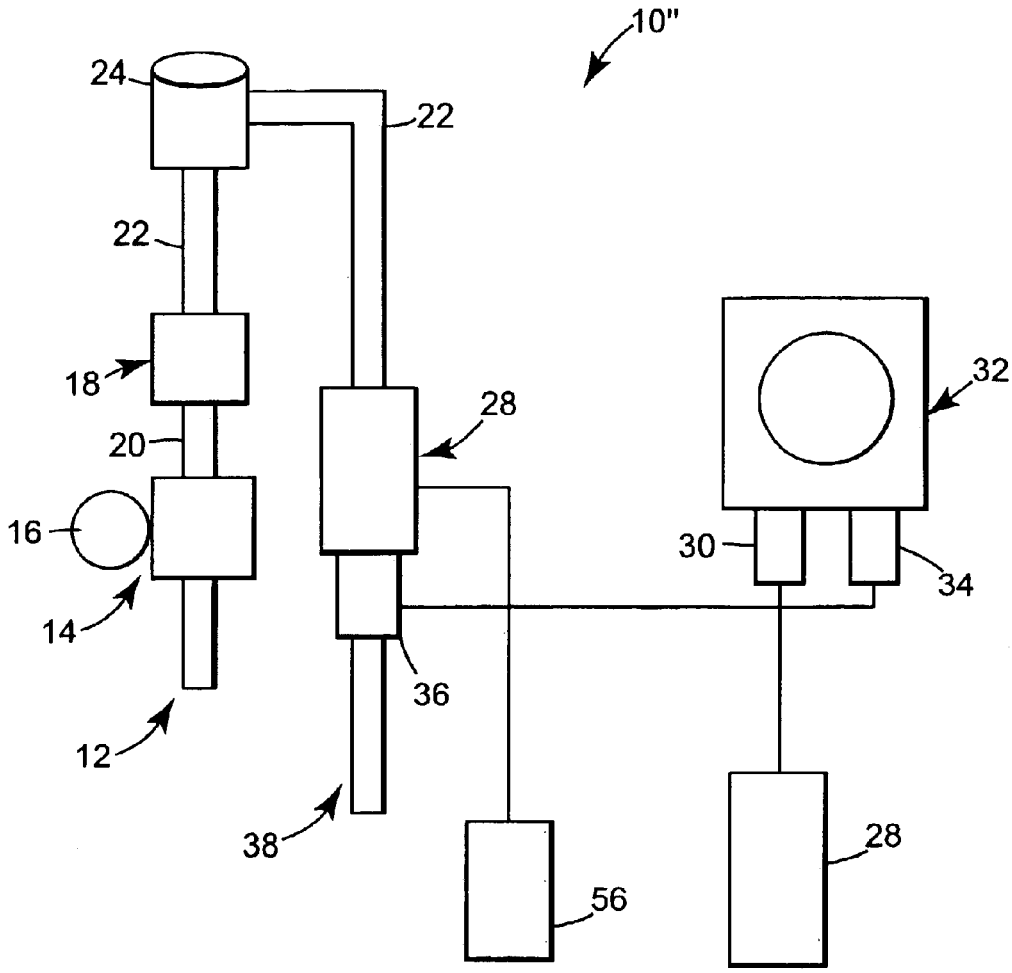
FIG. 3 is a block diagram of another embodiment of the present invention diluting a plurality of ingredient.

FIG. 3 illustrates an embodiment of apparatus 10" of the present invention in two concentrates. A first concentrate 28 and a second concentrate 56 are diluted with diluent, in this case, water, to form a use solution. In this embodiment, first concentrate 28 is diluted into diluent at a dilution ratio lower than 1:130 making the use of an aspirator unreliable and second concentrate 56 is diluted into diluent at a dilution ratio exceeding 1:130 allowing the use of an aspirator.

Water supply line 12, water pressure regulator 14, water pressure gauge 16, water lines 20 and 22, latching solenoid valve 18, vacuum break 24, constant flow rate pump 32 along with inlet 30 and outlet 34, tee 36 and outlet pipe 38 operate exactly as described with respect to FIG. 1. These components ensure that concentrate 28 will be accurately diluted into the diluent (water) to form a use solution in outlet pipe 38 at a dilution ratio not more than 1:130.

Concentrate 56 is also conventionally aspirated into outlet pipe 38 by conventional aspirator 58 at a dilution ratio typically exceeding 1:130.

Thus, apparatus 10" operates to add two concentrates (28 and 56) to the diluent flowing in water supply line 12 on demand from a user at differing dilution ratios. Concentrate 28 can be added at relatively low dilution rate while, at the same time, concentrate 56 can be added at a relatively high dilution rate. The addition of dual concentrates (28 and 56) may be advantageous to prepare use solutions using an active ingredient, such as a detergent, using concentrate 56 and, at the same time, using an added fragrance using concentrate 28. Fragrance from concentrate 28 is added at a higher dilution ratio than the active ingredient from concentrate 56.

The separation of fragrance from the active ingredient and the ability to add them separately to the resulting use solution allows use solutions having common active ingredients but with individualized fragrances. This separation allows individual accounts purchasing active ingredient to have an individualized fragrance specific to their use and needs. It is economically feasible because multiple varieties of the active ingredient do not need to be produced, stocked, shipped and stored for each separate individualized account.

Apparatus 10" can be used to distribute a product using concentrates and a locally obtained diluent from water supply line 12. A product diluted from a base concentrate, such as a cleaner or a sanitizer, can be distributed to a plurality of customers. The product, however, can be customized with the addition of a customizable concentrate, such as a fragrance. Thus, while many customers may get the base product with the base concentrate, the product may be individualized for individual customers by selecting a different customizable concentrate. Since only a small amount of the customizable concentrate may be required, e.g., with a fragrance, storage and distribution costs can be minimized with a common base concentrate utilized by many customers. Apparatus 10" is useful in this environment due to the ability to add a customizable concentrate, e.g., a fragrance, with a dilution rate of not more than 1:130.

In this embodiment, base concentrate can be utilized for second concentrate 56 in FIG. 3 which is aspirated into a locally obtained diluent, such as water, and customizable concentrate can be utilized for first concentrate 28 in FIG. 3. Since customizable concentrate is usually diluted at a relatively low dilution rate, e.g., not more than 1:130 while base concentrate usually has a lower dilution rate, apparatus 10" is an ideal mechanism to achieve distribution of a product of this type.

Various modifications and alterations of this invention will be apparent to those skilled in the art without departing from the scope and spirit of this invention. It should be understood that this invention is not limited to the illustrative embodiments set forth above.

What is claimed is:

1. An apparatus for creating a use solution of a first product diluted, with a dilution rate of not more than 1:130, and a second product diluted, with a dilution rate of more than 1:130, into a diluent flowing under pressure in a line, comprising:

a normally-closed, user activatable valve operatively coupled in said line allowing said second product to flow in said line upon user activation;

a flow regulator, operatively coupled in said line downstream of said valve, configured to maintain a constant flow rate for said diluent in said line;

an aspirator adapted to be fluidly coupled to said second product and operatively coupled in said line downstream of said flow regulator; and a constant flow rate pump having an inlet and an outlet and being operatively coupled to said valve, said inlet adapted to be operatively fluidly coupled to said first product and said outlet fluidly coupled to said line downstream of said flow regulator.

2. An apparatus as in claim 1 wherein said diluent is water.

3. An apparatus as in claim 1 wherein said constant flow rate pump is a peristaltic pump.

4. An apparatus as in claim 1 further comprising a pressure-operated electrical switch fluidly coupled in said line downstream of said valve and electrically coupled to said pump configured to activate said pump when said diluent flows in said line.

5. An apparatus as in claim 1 further comprising a vacuum break operatively coupled in said line between said valve and said flow regulator.

6. An apparatus as in claim 1 wherein said valve is a latching solenoid valve which opens for a predetermined period of time upon user activation.

7. An apparatus as in claim 1 wherein said outlet of said pump is coupled in said line downstream of said aspirator.

8. An apparatus as in claim 1 wherein said first product is a fragrance.

9. A method of creating a use solution of a first product diluted, with a dilution rate of not more than 1:130, and a second product diluted, with a dilution rate of more than 1:130, into a diluent flowing under pressure in a line, comprising the steps of:

opening a normally-closed, user activatable valve operatively coupled in said line allowing said second product to flow in said line;

regulating flow in said line downstream of said valve to maintain a constant flow rate for said diluent in said line;

aspirating said second product and operatively into said line downstream of said flow regulator; and pumping said first product into said line downstream of said flow regulator using a constant flow rate pump.

10. A method as in claim 9 wherein said diluent is water.

11. A method as in claim 9 wherein said constant flow rate pump is a peristaltic pump.

12. A method as in claim 9 wherein said opening step also comprises activating said pumping step.

13. A method as in claim 9 further comprises breaking a vacuum in said line between said valve and said flow regulator.

14. A method as in claim 9 wherein said opening step opens said valve for a predetermined period of time.

15. A method as in claim 9 wherein said first product is pumped into said line downstream of where said second is aspirated into said line.

16. A method as in claim 9 wherein said first product is a fragrance.

17. A method of distributing a product to a plurality of customers, said product constituted from a base concentrate and a customizable concentrate, selectable from a plurality of customizable concentrates, to each of said plurality of customers, comprising;

distributing said base concentrate to each of said plurality of customers;

distributing a different selected one of said plurality of customizable concentrates to each of said plurality of customers; and diluting said base concentrate with a locally obtained diluent and diluting said different selected one of said plurality of customizable concentrates in a dilution rate of not more than 1:130 with said locally obtained diluent.

18. A method as in claim 17 wherein said diluent is water.

19. A method as in claim 18 wherein said customizable concentrate is a fragrance.

20. A method as in claim 19 wherein said base concentrate is a sanitizer.

21. A method as in claim 19 wherein said base concentrate is a cleaner.

* * * * *